US012313073B2

(12) United States Patent
Seol et al.

(10) Patent No.: US 12,313,073 B2
(45) Date of Patent: May 27, 2025

(54) ROTARY COMPRESSOR

(71) Applicant: LG ELECTRONICS INC., Seoul (KR)

(72) Inventors: Seseok Seol, Seoul (KR); Yunhi Lee, Seoul (KR); Seoungmin Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/616,519

(22) Filed: Mar. 26, 2024

(65) Prior Publication Data

US 2024/0344518 A1 Oct. 17, 2024

(30) Foreign Application Priority Data

Apr. 11, 2023 (KR) ..... 10-2023-0047706

(51) Int. Cl.

| | |
|---|---|
| ***F04C 18/22*** | (2006.01) |
| ***F04C 18/34*** | (2006.01) |
| ***F04C 18/344*** | (2006.01) |
| ***F04C 18/356*** | (2006.01) |
| ***F04C 29/06*** | (2006.01) |

(52) U.S. Cl.

CPC ..... *F04C 29/06* (2013.01); *F04C 18/22* (2013.01); *F04C 18/344* (2013.01); *F04C 18/356* (2013.01); *F04C 2210/261* (2013.01); *F04C 2210/268* (2013.01); *F04C 2240/30* (2013.01); *F04C 2240/50* (2013.01)

(58) Field of Classification Search

CPC ..... F04C 29/06; F04C 18/22; F04C 18/34; F04C 18/344; F04C 18/356

See application file for complete search history.

(56) References Cited

U.S. PATENT DOCUMENTS

| | | | | |
|---|---|---|---|---|
| 12,123,414 | B2 * | 10/2024 | Park | F25B 31/026 |
| 2015/0132168 | A1 | 5/2015 | Tsuda et al. | |
| 2019/0211681 | A1 * | 7/2019 | Moon | F01C 21/0809 |

FOREIGN PATENT DOCUMENTS

| | | | | |
|---|---|---|---|---|
| JP | 2013-213438 | | 10/2013 | |
| KR | 20190084514 | A * | 1/2018 | F04C 28/26 |
| KR | 10-2020-0057542 | | 5/2020 | |

OTHER PUBLICATIONS

English KR 201900846514 by PE2E Jul. 8, 2021.*

* cited by examiner

*Primary Examiner* — Deming Wan
(74) *Attorney, Agent, or Firm* — KED & ASSOCIATES

(57) ABSTRACT

A rotary compressor is provided that may include a casing, a cylinder, a main bearing, a sub bearing, a rotational shaft, a roller, and at least one vane. The cylinder may include at least one elastic deformation unit to absorb impact with the at least one vane. With this structure, a collision force caused due to chattering of the at least one vane may be absorbed to suppress or prevent friction loss and/or wear between the cylinder and the vane, thereby enhancing compressor efficiency, reducing vibration noise, and enabling fast initial actuation.

19 Claims, 12 Drawing Sheets

ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2023-0047706, filed in Korea on Apr. 11, 2023, the contents of which are incorporated by reference herein in their entirety.

BACKGROUND

1. Field

A concentric rotary compressor in which a vane is slidably coupled to a roller is disclosed herein.

2. Background

Rotary compressors may be classified into two types, namely, a type in which a vane is slidably inserted into a cylinder to be in contact with a roller, and another type in which a vane is slidably inserted into a roller to be in contact with a cylinder. In general, the former is called a roller eccentric rotary compressor (hereinafter, referred to as a "rotary compressor"), and the latter is referred to as a vane concentric rotary compressor (hereinafter, referred to as a "concentric rotary compressor").

As for a rotary compressor, a vane inserted in a cylinder is pulled out toward a roller by elastic force or back pressure to come into contact with an outer circumferential surface of the roller. The rotary compressor independently forms compression chambers as many as the number of vanes per revolution of the roller, and the compression chambers simultaneously perform suction, compression, and discharge strokes.

On the other hand, as for a concentric rotary compressor, a vane inserted in a roller rotates together with the roller, and is pulled out by centrifugal force and back pressure to come into contact with an inner circumferential surface of a cylinder. The concentric rotary compressor continuously forms as many compression chambers as the number of vanes per revolution of the roller, and the compression chambers sequentially perform suction, compression, and discharge strokes. Accordingly, the concentric rotary compressor has a higher compression ratio than the rotary compressor. Therefore, the concentric rotary compressor is more suitable for high pressure refrigerants, such as R32, R410a, and $CO_2$, which have low ozone depletion potential (ODP) and global warming index (GWP).

The related art vane rotary compressor discloses a structure in which a plurality of vanes is slidably inserted into a roller. In the related art vane rotary compressor, a back pressure chamber is formed at a rear end portion of the vane, to communicate with a back pressure pocket. The back pressure pocket is divided into a first pocket forming an intermediate pressure and a second pocket forming a discharge pressure or an intermediate pressure close to the discharge pressure. The first pocket communicates with a back pressure chamber located at an upstream side and the second pocket communicates with a back pressure chamber located at a downstream side, with respect to a direction from a suction side to a discharge side.

However, in the related art concentric rotary compressor as described above, vane chattering may occur due to the vane, which rotates with the roller during operation, being pushed in a direction toward an inner circumferential surface of the cylinder by receiving the combined force of the centrifugal force and back pressure, and then pushed back to the roller by the pressure of the compression chamber. During this process, a front end surface of the vane strongly collides with the inner circumferential surface of the cylinder, which not only increases friction loss between the front end surface of the vane and the inner circumferential surface of the cylinder, but also causes compression loss due to wear of the front end surface of the vane and/or the inner circumferential surface of the cylinder. In particular, this phenomenon may be severe at an initial startup of the compressor, which causes an initial actuation failure, thereby lowering efficiency of the compressor and delaying cooling and heating effects when applied to a cooling and heating device.

In addition, in the related art concentric rotary compressor, the chattering of the vane intensively occurs around a contact point, and thereby the inner circumferential surface of the cylinder or the front end surface of the vane may be worn around the contact point. As a result, vibration noise in a specific area may be increased and leakage between compression chambers may occur, thereby decreasing compression efficiency.

Further, in the related art vane rotary compressor, pressure pulsation may be caused by non-uniform pressure of oil supplied toward a rear end surface of the vane. Accordingly, back pressure formed on the rear end surface of the vane may become inconsistent, causing more severe chattering of the vane.

Those problems become more serious when a high-pressure refrigerant, such as R32, R410a, or $CO_2$ is used. In more detail, when the high-pressure refrigerant is used, a same level of cooling capability may be obtained as that obtained when using a relatively low-pressure refrigerant, such as R134a, even though a volume of each compression chamber is reduced by increasing the number of vanes. However, as the number of vanes increases, a friction area between the vanes and the cylinder increases accordingly. Therefore, in the case of high-pressure refrigerant, the pressure difference between both ends of the vane further increases, further increasing friction loss and/or wear between the cylinder and the vane. This may be more greatly affected under heating and low-temperature conditions, a high-pressure ratio condition ($Pd/Ps \geq 6$), and a high-speed driving condition (80 Hz or more).

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a concentric rotary compressor according to exemplary embodiments disclosed herein, with reference to the accompanying drawings. For reference, an oil supply hole according to embodiments may be equally applied to a concentric rotary compressor in which a vane is slidably inserted into the roller.

For example, embodiments may be applied not only to an example in which the vane slot is inclined but also to an example in which the vane slot is formed radially. Hereinafter, an example in which a vane slot is inclined relative to a roller and an inner circumferential surface of a cylinder has an asymmetric elliptical shape will be described as a representative example.

In addition, embodiments may be equally applied to a horizontal type in which a casing is parallel to an installation surface as well as a vertical type in which the casing is perpendicular to the installation surface as illustrated in an embodiment disclosed herein. Hereinafter, a vertical type compressor will be explained as a representative example.

Figure 1:
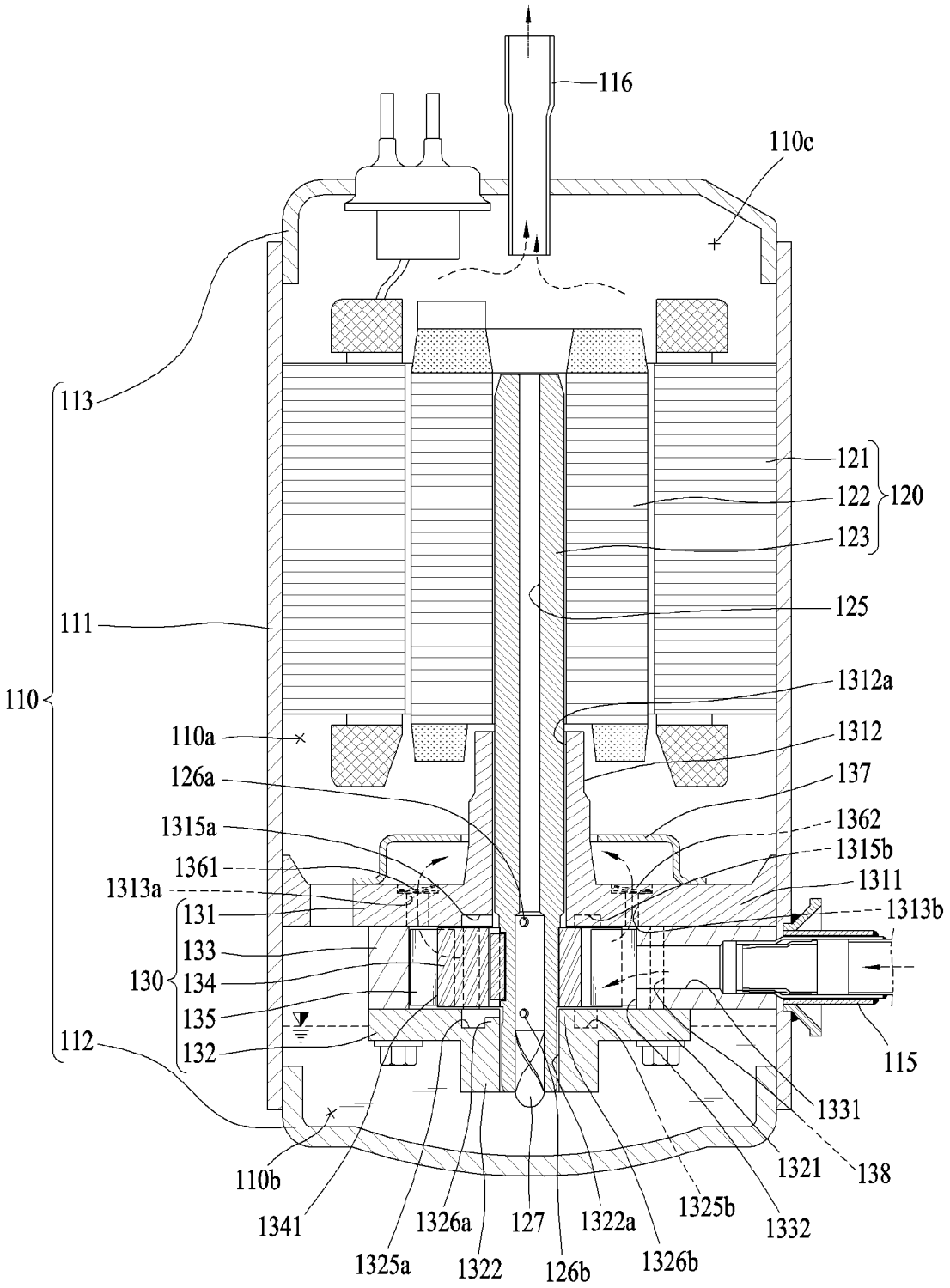
FIG. 1 is a cross-sectional view of a concentric rotary compressor according to an embodiment.
Figure 2:
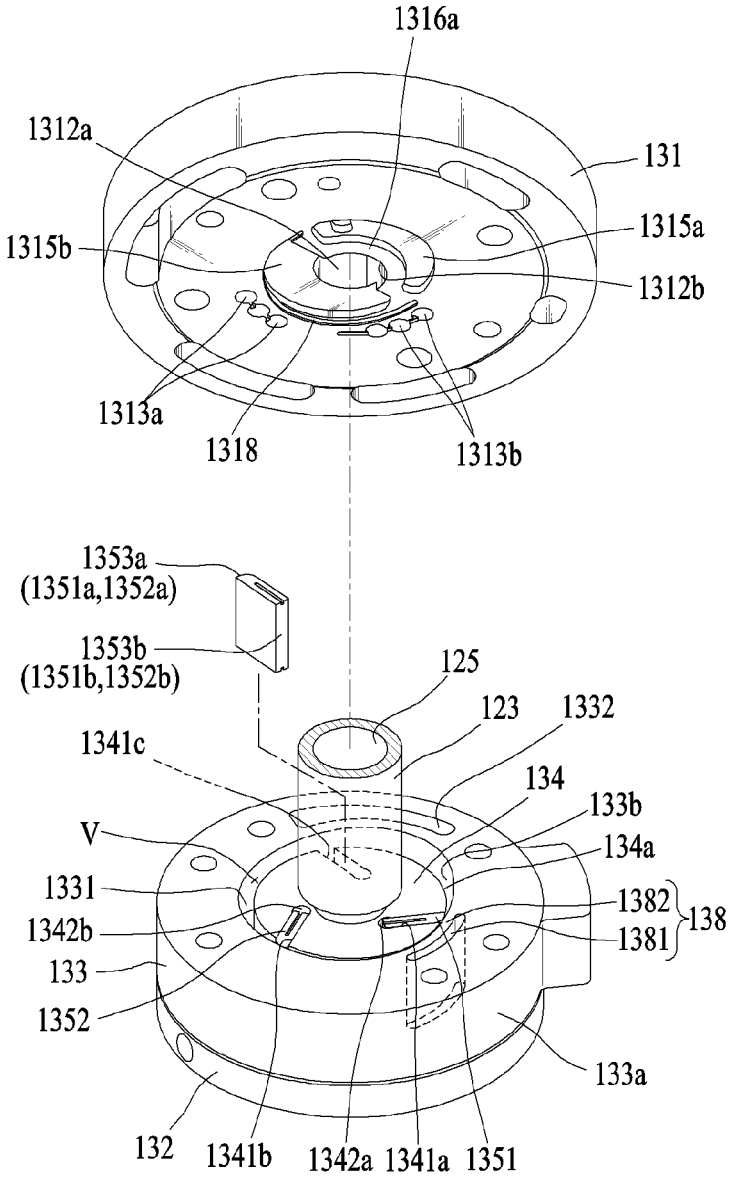
FIG. 2 is an exploded perspective view of a compression unit in FIG. 1.
Figure 3:
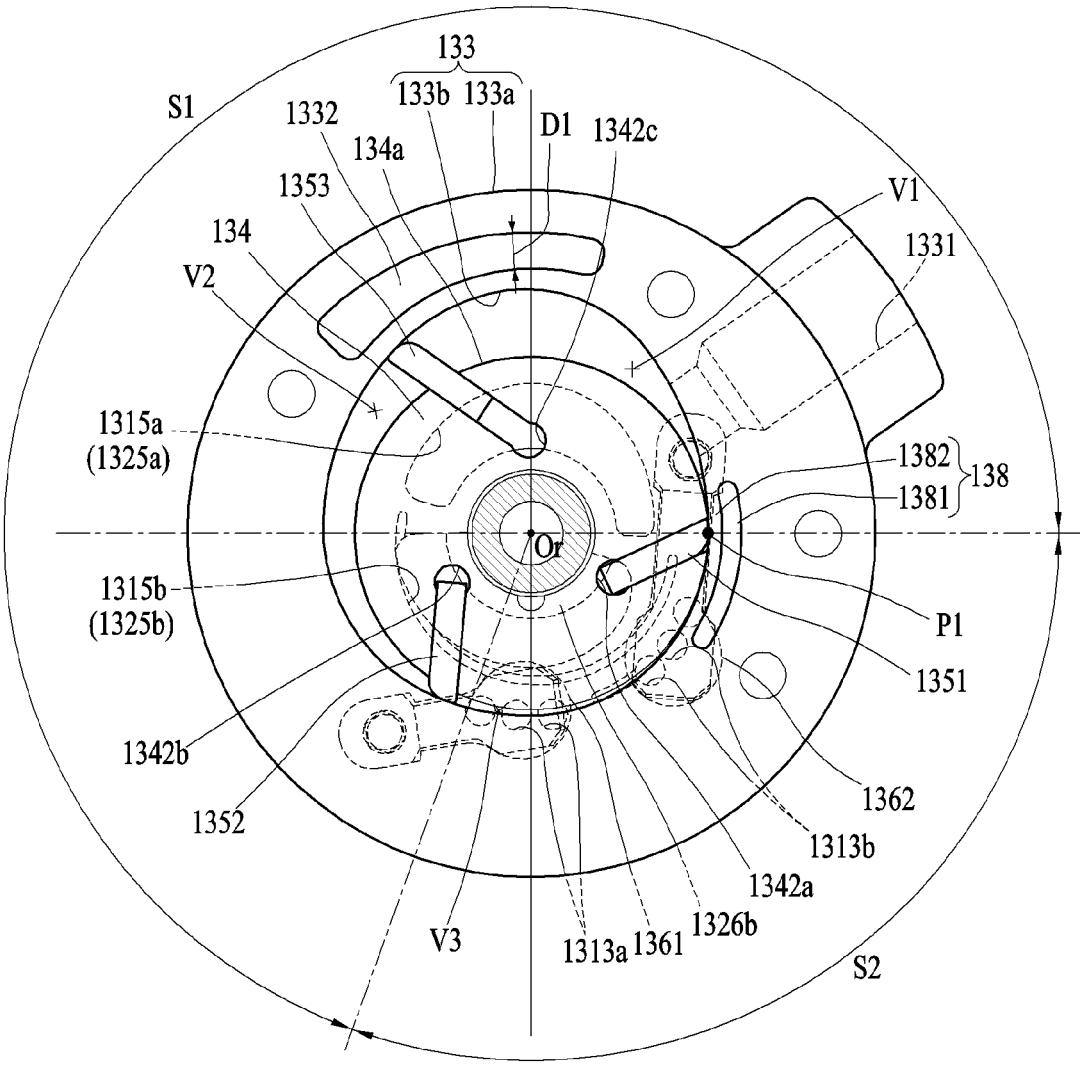
FIG. 3 is a planar view of an assembled state of the compression unit in FIG. 2.

FIG. 1 is a cross-sectional view of a concentric rotary compressor according to an embodiment, FIG. 2 is an exploded perspective view of a compression unit in FIG. 1, and FIG. 3 is an assembled planar view of the compression unit in FIG. 2.

Referring to FIG. 1, a concentric rotary compressor (hereinafter, referred to as a rotary compressor) according to an embodiment may include a casing 110, a drive motor 120, and a compression unit 130. The drive motor 120 may be installed in an upper inner space 110*a* of the casing 110, and the compression unit 130 may be installed in a lower inner space 110*a* of the casing 110. The drive motor 120 and the compression unit 130 are connected through a rotational shaft 123.

The casing 110 may define an appearance of the compressor and include an intermediate shell 111 having a cylindrical shape, a lower shell 112 that covers a lower end of the intermediate shell 111, and an upper shell 113 that covers an upper end of the intermediate shell 111. The drive motor 120 and the compression unit 130 may be inserted into the intermediate shell 111 to be fixed thereto, and a suction pipe 115 may penetrate through the intermediate shell 111 to be directly connected to the compression unit 130. The lower shell 112 may be coupled to a lower end of the intermediate shell 111 in a sealing manner, and an oil storage space 110*b* in which oil to be supplied to the compression unit 130 is stored may be formed below the compression unit 130. The upper shell 113 may be coupled to an upper end of the intermediate shell 111 in a sealing manner, and an oil separation space 110*c* may be formed above the drive motor 120 to separate oil from refrigerant discharged from the compression unit 130.

The drive motor 120 that constitutes a motor supplies power to cause the compression unit 130 to be driven. The drive motor 120 may include a stator 121, a rotor 122, and the rotational shaft 123.

The stator 121 may be fixedly inserted into the casing 110. The stator 121 may be fixed to an inner circumferential surface of the casing 110 in, for example, a shrink-fitting manner. For example, the stator 121 may be press-fitted into an inner circumferential surface of the intermediate shell 111.

The rotor 122 may be rotatably inserted into the stator 121, and the rotational shaft 123 may be, for example, press-fitted into a center of the rotor 122. Accordingly, the rotational shaft 123 rotates concentrically together with the rotor 122.

An oil flow path 125 having a hollow hole shape may be formed in a central portion of the rotational shaft 123, and oil passage holes 126*a* and 126*b* may be formed through a middle portion of the oil flow path 125 toward an outer circumferential surface of the rotational shaft 123. The oil passage holes 126*a* and 126*b* may include first oil passage hole 126*a* belonging to a range of a main bush portion 1312 described hereinafter and second oil passage hole 126*b* belonging to a range of a second bearing portion 1322. Each of the first oil passage hole 126*a* and the second oil passage hole 126*b* may be provided as one or as a plurality. In this embodiment, each of the first and second oil passage holes is provided as a plurality.

An oil pickup 127 may be installed in a middle or lower end of the oil passage 125. A gear pump, a viscous pump, or a centrifugal pump may be used for the oil pickup 127. This embodiment illustrates a case in which the centrifugal pump is employed. Accordingly, when the rotational shaft 123 rotates, oil filled in the oil storage space 110*b* is pumped by the oil pickup 127 and is suctioned along the oil flow path 125, so as to be introduced into a sub bearing surface 1322*b* of the sub bush portion 1322 through the second oil passage hole 126*b* and into a main bearing surface 1312*b* of the main bush portion 1312 through the first oil passage hole 126*a*.

The compression unit 130 may include a main bearing 131, a sub bearing 132, a cylinder 133, a roller 134, and a plurality of vanes 1351, 1352, and 1353. The main bearing 131 and the sub bearing 132 may be respectively provided at upper and lower parts or portions of the cylinder 133 to define a compression space V together with the cylinder 133, the roller 134 may be rotatably installed in the compression space V, and the plurality of vanes 1351, 1352, and 1353 may be slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and, for example, welded thereto.

The main bearing 131 may be coupled to an upper end of the cylinder 133 in a close contact manner. Accordingly, the main bearing 131 may define an upper surface of the compression space V, and support an upper surface of the roller 134 in an axial direction while supporting an upper-half portion of the rotational shaft 123 in a radial direction.

The main bearing 131 may include a main plate portion 1311 and a main bush portion 1312. The main plate portion 1311 may cover the upper portion of the cylinder 133 to be coupled thereto, and the main bush portion 1312 may axially extend from a center of the main plate portion 1311 toward the drive motor 120 so as to support an upper portion of the rotational shaft 123.

The main plate portion 1311 may have a disk shape, and an outer circumferential surface of the main plate portion 1311 may be fixed to the inner circumferential surface of the intermediate shell 111 in a close contact manner. One or more discharge ports 1313*a*, 1313*b* may be formed in the main plate portion 1311. A plurality of discharge valves 1361, 1362 configured to open and close the respective discharge ports 1313*a*, 1313*b* may be installed on an upper surface of the main plate portion 1311. A discharge muffler 137 having a discharge space (no reference numeral) may be provided at an upper part or portion of the main plate portion 1311 to accommodate the discharge ports 1313*a*, 1313*b* and the discharge valves 1361, 1362.

A first main back pressure pocket 1315*a* and a second main back pressure pocket 1315*b* may be formed in the main plate portion 1311 facing the upper surface of the roller 134, of both axial side surfaces of the main plate portion 1311. The first main back pressure pocket 1315*a* and the second main back pressure pocket 1315*b* each having an arcuate shape may be disposed at a predetermined interval in a circumferential direction. Each of the first main back pressure pocket 1315*a* and the second main back pressure pocket 1315*b* may have an inner circumferential surface with a circular shape, but may have an outer circumferential surface with an oval or elliptical shape in consideration of vane slots described hereinafter.

The first main back pressure pocket 1315*a* forms a pressure lower than a pressure formed in the second main back pressure pocket 1315*b*, for example, forms an intermediate pressure between a suction pressure and a discharge pressure. Oil (refrigerant oil) may pass through a fine passage between a first main bearing protrusion 1316*a* described hereinafter and the upper surface 134*a* of the roller 134 so as to be introduced into the first main back pressure pocket 1315*a*. The first main back pressure pocket 1315*a* may be formed in a range of a compression chamber forming the intermediate pressure in the compression space V. This may allow the first main back pressure pocket 1315*a* to maintain the intermediate pressure.

The second main back pressure pocket 1315*b* may form a pressure higher than that in the first main back pressure pocket 1315*a*, for example, the discharge pressure or the intermediate pressure between the suction pressure close to the discharge pressure and the discharge pressure, such that refrigerant flows directly into the second main back pressure pocket 1315*b* through the first oil passage hole 126*a*. The second main back pressure pocket 1315*b* may be formed in a range of a compression chamber forming the discharge pressure in the compression space V. This may allow the second main back pressure pocket 1315*b* to maintain the discharge pressure.

Referring to FIGS. 1 to 3, the sub bearing 132 may be coupled to a lower end of the cylinder 133 in a close contact manner. Accordingly, the sub bearing 132 defines a lower surface of the compression space V, and supports a lower surface of the roller 134 in the axial direction while supporting a lower-half portion of the rotational shaft 123 in the radial direction.

The sub bearing 132 may include a sub plate portion 1321 and the sub bush portion 1322. The sub plate portion 1321 covers the lower portion of the cylinder 133 to be coupled to thereto, and the sub bush portion 1322 axially extends from a center of the sub plate portion 1321 toward the lower shell 112 so as to support the lower portion of the rotational shaft 123. The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed in the sub plate portion 1321 facing the lower surface of the roller 134, of both axial side surfaces of the sub plate portion 1321. The first sub back pressure pocket 1325*a* and the second sub back pressure pocket 1325*b* may be symmetric to the first main back pressure pocket 1315*a* and the second main back pressure pocket 1315*b*, respectively, with respect to the roller 134. For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other.

Referring to FIGS. 1 to 3, the cylinder 133 according to this embodiment may be in close contact with the main plate portion 1311 of the main bearing 131 and the sub plate portion 1321 of the sub bearing 132 and coupled by, for example, bolts to the main bearing 131 together with the sub bearing 131. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 described hereinafter may be rotatably coupled to the compression space V.

The cylinder 133 may be provided with a suction port 1331 that penetrates from an outer circumferential surface 133*a* to an inner circumferential surface 133*b* thereof. However, the suction port 1331 may alternatively be formed through the main bearing 131 or the sub bearing 132. For example, the suction port 1331 may be formed at one side in the circumferential direction based on a contact point P1, which will be described hereinafter, that is, at an opposite side to the discharge port 1313 based on the contact point P1.

The inner circumferential surface 1333 of the cylinder 133 may be formed in an elliptical shape. The inner circumferential surface 133*b* of the cylinder 133 according to this embodiment may be formed in an asymmetric elliptical shape in which a plurality of ellipses, for example, four ellipses having different major and minor ratios are combined to have two origins.

The cylinder 133 may include a pulsation buffer 1332 that lowers a pulsation pressure of a back pressure chamber 1342*a*, 1342*b*, 1342*c*, which will be described hereinafter, including back pressure pockets [(1315*a*), (1315*b*)] and [(1325*a*), (1325*b*)]. For example, the pulsation buffer 1332 may be formed in a penetrating or recessing manner by a preset or predetermined circumferential length between the outer circumferential surface 133*a* and the inner circumferential surface 133*b* of the cylinder 133. The pulsation buffer 1332 may communicate with the first main back pressure pocket 1315*a* and/or the first sub back pressure pocket 1325*a* disposed in the main bearing 131 and/or sub bearing 132. This may expand a volume of the first main back pressure pocket 1315*a* and/or the first sub back pressure pocket 1325*a*, to maintain the back pressure of each vane 1351, 1352, 1353 as uniformly as possible.

The pulsation buffer 1332 may extend lengthwise in the circumferential direction, that is, in an arcuate shape. For example, the pulsation buffer 1332 may extend lengthwise in the circumferential direction along a rotational direction of the roller 134 between the suction port 1331 and the first discharge port 1313*a*. Accordingly, by making the volume of the pulsation buffer 1332 as wide as possible to effectively cancel out the pulsation pressure, the back pressure of the vane 1351, 1352, 1353 may be kept as constant as possible.

The pulsation buffer 1332 may extend in a radial direction. For example, a radial width D1 of the pulsation buffer 1332 may be approximately ⅓ or more of a radial width of the cylinder 133, that is, may be wider than or equal to a radial width D2 of a space portion 1381 defining a portion of an elastic deformation unit 138 explained hereinafter. Accordingly, the pulsation pressure may be effectively offset by making the volume of the pulsation buffer 1332 as wide as possible while maintaining a rigidity of the cylinder 133.

Additionally, the cylinder 133 may be provided with the elastic deformation unit 138 that attenuates a collision force caused by the contact with the vane 1351, 1352, 1353. For example, the elastic deformation unit 138 may extend by a preset or predetermined circumferential length in the circumferential direction from the inner circumferential surface 133*b* of the cylinder 133 and/or between the outer circumferential surface 133*a* and the inner circumferential surface 133*b*. Accordingly, the elastic deformation unit 138 may absorb and cancel an impact between the inner circumferential surface 133*b* of the cylinder 133 and the front end surface 1351*a*, 1352*a*, 1353*a* of the vane 1351, 1352, 1353, which is generated when the vane 1351, 1352, 1353 chatters. This may suppress or prevent friction loss and/or wear on the front end surface 1351*a*, 1352*a*, 1353*a* of the vane 1351, 1352, 1353 and/or the inner circumferential surface 133*b* of the cylinder 133.

The elastic deformation unit 138 may include the space portion 1381 and an elastic portion 1382. In other words, the elastic deformation unit 138 may include the space portion 1381 that is formed, for example, in a coring manner between the outer circumferential surface 133*a* and the inner circumferential surface 133*b* of the cylinder 133, and the elastic portion 1382 that connects both inner ends of the space portion 1381 to define the inner circumferential surface 133*b* of the cylinder 133. Accordingly, an impact that is generated due to collision between the vane 1351, 1352, 1353 and the cylinder 133 during chattering of the vane 1351, 1352, 1353 may be absorbed by the elastic deformation unit 138, thereby suppressing or preventing friction loss and/or wear between the vane 1351, 1352, 1353 and the cylinder 133. The pulsation buffer 1332 will be described again hereinafter together with the elastic deformation unit 138.

Referring to FIGS. 1 to 3, the roller 134 may be rotatably disposed in the compression space V of the cylinder 133, and the plurality of vanes 1351, 1352, 1353 explained hereinafter may be inserted in the roller 134 at preset or predetermined gaps along the circumferential direction. Accordingly, the compression space V may be partitioned into as many compression chambers as the number of the plurality of vanes 1351, 1352, and 1353. This embodiment illustrates an example in which the plurality of vanes 1351, 1352, and 1353 are three, and thus, the compression space V is partitioned into three compression chambers V1, V2, and V3.

The outer circumferential surface of the roller 134 according to this embodiment may be formed in a circular shape, and the rotational shaft 123 may extend as a single body from or may be post-assembled and coupled to a rotational center Or of the roller 134. Accordingly, the rotational center Or of the roller 134 is coaxially located with an axial center (no reference numeral) of the rotational shaft 123, and the roller 134 rotates concentrically with the rotational shaft 123.

However, as described above, as the inner circumferential surface 133*b* of the cylinder 133 is formed in an asymmetric elliptical shape biased in a specific direction, the rotational center Or of the roller 134 may be eccentrically disposed with respect to an outer diameter center of the cylinder 133. Accordingly, one side of the outer circumferential surface of the roller 134 may be almost brought into contact with the inner circumferential surface 133*b* of the cylinder 133, thereby defining the contact point P1.

In addition, the plurality of vane slots 1341*a*, 1341*b*, and 1341*c* may be formed in the outer circumferential surface of the roller 134 to be spaced apart from each other in the circumferential direction. The plurality of vanes 1351, 1352, and 1353 described hereinafter may be slidably inserted into the plurality of vane slots 1341*a*, 1341*b*, and 1341*c*, respectively.

The plurality of vane slots 1341*a*, 1341*b*, and 1341*c* may be defined as first vane slot 1341*a*, second vane slot 1341*b*, and third vane slot 1341*c* along a compression-proceeding direction (a rotational direction of the roller). The first vane slot 1341*a*, the second vane slot 1341*b*, and the third vane slot 1341*c* may be formed in the same manner at equal or unequal intervals along the circumferential direction.

For example, each of the vane slots 1341*a*, 1341*b*, and 1341*c* may be inclined by preset or predetermined angles with respect to the radial direction, so as to secure a sufficient length of each of the vanes 1351, 1352, and 1353. Accordingly, when the inner circumferential surface 133*b* of the cylinder 133 is formed in the asymmetric elliptical shape, separation of the vane 1351, 1352, 1353 from the vane slot 1341*a*, 1341*b*, 1341*c* may be suppressed or prevented even if a distance from the outer circumferential surface of the roller 134 to the inner circumferential surface 133*b* of the cylinder 133 increases. This may result in enhancing freedom of design for the inner circumferential surface 133*b* of the cylinder 133.

A direction in which the vane slot 1341*a*, 1341*b*, 1341*c* is inclined may be a reverse direction to the rotational direction of the roller 134. That is, the front end surface of the vane 1351, 1352, 1353 in contact with the inner circumferential surface 133*b* of the cylinder 133 may be inclined toward the rotational direction of the roller 134. This may be advantageous in that a compression start angle may be formed ahead in the rotational direction of the roller 134 so that compression may start quickly.

The back pressure chambers 1342*a*, 1342*b*, and 1342*c* may be formed to communicate with inner ends of the vane slots 1341*a*, 1341*b*, and 1341*c*, respectively. The back pressure chambers 1342*a*, 1342*b*, and 1342*c* may be spaces in which oil (or refrigerant) of a discharge pressure or intermediate pressure is filled to flow toward rear sides of the vanes 1351, 1352, and 1353, that is, vane rear end portions 1351*c*, 1352*c*, and 1353*c*. The vanes 1351, 1352, and 1353 may be pressed toward the inner circumferential surface 133*b* of the cylinder 133 by the pressure of the oil (or refrigerant) filled in the back pressure chambers 1342*a*, 1342*b*, and 1342*c*. For convenience, hereinafter, a direction toward the cylinder 133 based on a movement direction of the vanes 1351, 1352, and 1353 may be defined as a front side and an opposite side as a rear side.

The back pressure chamber 1342*a*, 1342*b*, 1342*c* may be hermetically sealed by the main bearing 131 and the sub bearing 132. The back pressure chambers 1342*a*, 1342*b*, and 1342*c* may independently communicate with each of the back pressure pockets [1315*a*, and 1315*b*], [1325*a*, and 1325*b*], and may also communicate with each other through the back pressure pockets [1315*a*, and 1315*b*], and [1325*a*, and 1325*b*]

Referring to FIGS. 1 to 3, the plurality of vanes 1351, 1352, and 1353 according to this embodiment may be slidably inserted into the respective vane slots 1341*a*, 1341*b*, and 1341*c*. Accordingly, the plurality of vanes 1351, 1352, and 1353 may have substantially a same shape as the respective vane slots 1341*a*, 1341*b*, and 1341*c*.

For example, the plurality of vanes 1351, 1352, and 1353 are defined as first vane 1351, second vane 1352, and third vane 1353 along the rotational direction of the roller 134. The first vane 1351 may be inserted into the first vane slot 1341*a*, the second vane 1352 may be inserted into the second vane slot 1341*b*, and the third vane 1353 may be inserted into the third vane slot 1341*c*, respectively.

The plurality of vanes 1351, 1352, and 1353 may have substantially a same shape. More specifically, each of the plurality of vanes 1351, 1352, and 1353 may be formed substantially in a rectangular parallelepiped shape. The front end surface 1351*a*, 1352*a*, 1353*a* in contact with the inner circumferential surface 133*b* of the cylinder 133 may be formed as a curved surface and the rear end surface 1351*b*, 1352*b*, 1353*b* facing the back pressure chamber 1342*a*, 1342*b*, 1342*c* may be formed as a linear surface.

Hereinafter, operation of the concentric rotary compressor according to an embodiment will be described.

That is, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. Then, the plurality of vanes 1351, 1352, and 1353 may be drawn out of the vane slots 1341*a*, 1341*b*, and 1341*c* by centrifugal force generated by the rotation of the roller 134 and back pressure of the back pressure chambers 1342*a*, 1342*b*, and 1342*c*, which support the rear end surfaces 1351*b*, 1352*b*, and 1353*b* of the vanes 1351, 1352, and 1353, thereby being brought into contact with the inner circumferential surface 133*b* of the cylinder 133.

The compression space V of the cylinder 133 may be partitioned by the plurality of vanes 1351, 1352, and 1353 into as many compression chambers (including suction chamber or discharge chamber) V1, V2, and V3 as the number of the vanes 1351, 1352, and 1353. The compression chambers V1, V2, and V3 may be changed in volume by the shape of the inner circumferential surface 133*b* of the cylinder 133 and eccentricity of the roller 134 while moving in response to the rotation of the roller 134. Accordingly, refrigerant suctioned into the respective compression chambers V1, V2, and V3 may be compressed while moving along the roller 134 and the vanes 1351, 1352, and 1353, and discharged into the inner space of the casing 110. Such series of processes may be repeatedly carried out.

On the other hand, as described above, in the rotary compressor, friction loss or wear may be caused as the front end surface 1351*a*, 1352*a*, 1353*a* of the vane 1351, 1352, 1353 is excessively in contact or collides with the inner circumferential surface 133*b* of the cylinder 133 by the centrifugal force generated when the roller rotates and the back pressure transmitted through the back pressure pocket and the back pressure chamber. In particular, in the vicinity of the contact point between the cylinder 133 and the roller, chattering of each vane 1351, 1352, 1353 may occur more severely due to pressure imbalance between both ends of the vane 1351, 1352, 1353. The excessive contact and/or chattering of the vane 1351, 1352, 1353 may cause leakage between compression chambers to end up with suction loss and compression loss, cause hitting noise and vibration between the cylinder 13 and the vane 1351, 1352, 1353, and aggravate the suction loss and compression loss due to wear of the cylinder 133 or the vane 1351, 1352, 1353.

Therefore, in this embodiment, friction loss and/or wear may be suppressed or prevented by attenuating pushing force which is generated when the front end surface of the vane is in excessive contact with the inner circumferential surface of the cylinder and/or absorbing an impact generated when the front end surface of the vane and the cylinder collide with each other. For example, the cylinder may include an elastic deformation unit that may attenuate an excessive contact and/or impact that may occur between the cylinder and a vane. Hereinafter, a hybrid cylinder with an inner circumferential surface which is defined by a combination of a plurality of ovals will be described as an example, but embodiments may be equally applied even to a typical cylinder with an inner circumferential surface formed in a circular shape. Further, description will be given of an example in which one contact point is formed between the cylinder and the roller, but embodiments may be equally applied even when there are a plurality of contact points.

Figure 4:
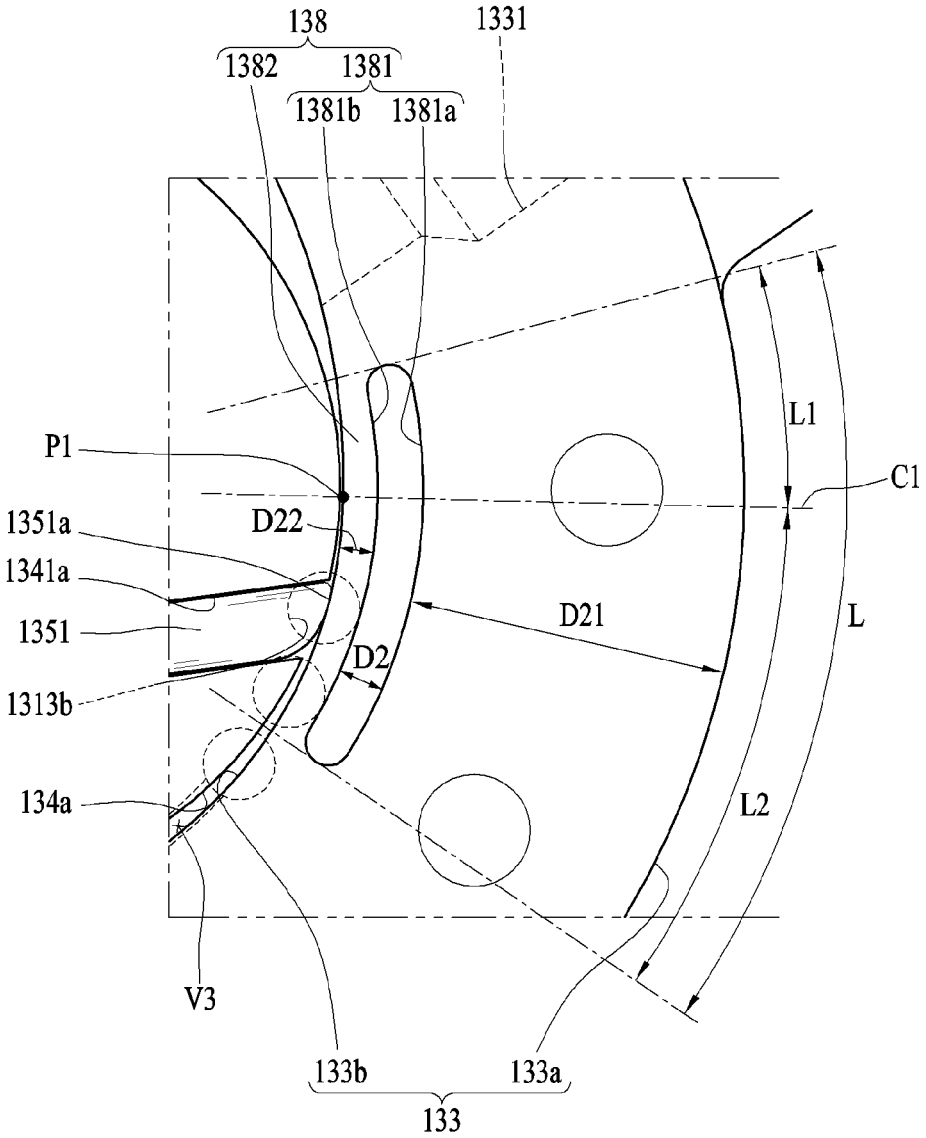
FIG. 4 is an exploded planar view of an elastic deformation unit in accordance with an embodiment.
Figure 5:
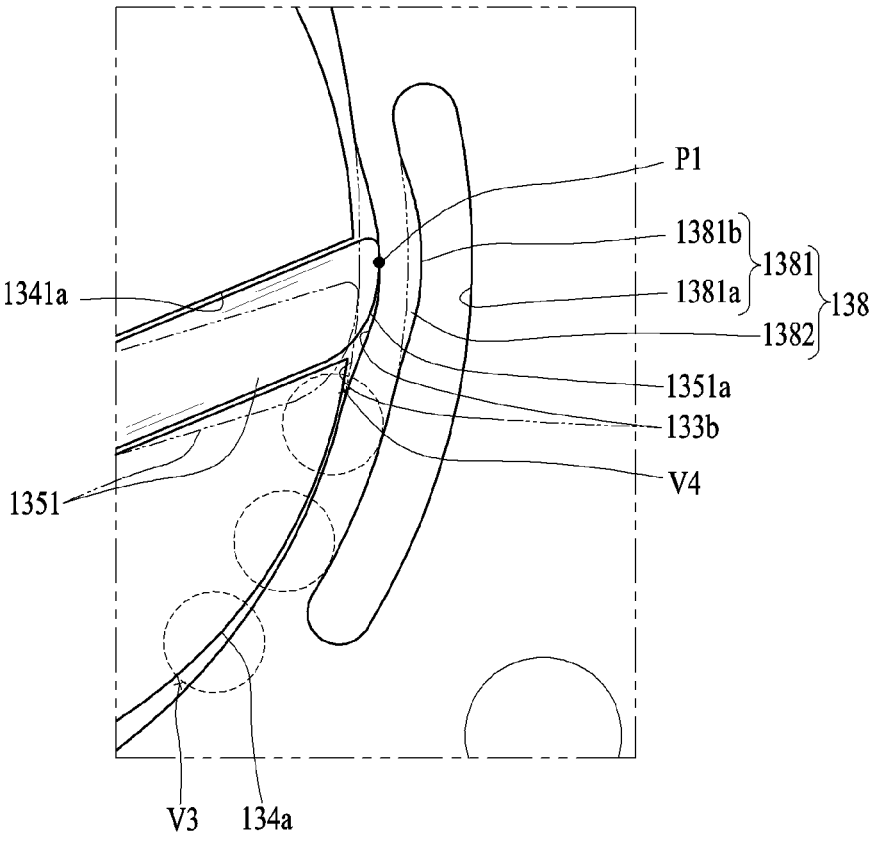
FIG. 5 is a schematic view for explaining operation of the elastic deformation unit according to an embodiment.

FIG. 4 is an exploded planar view of an elastic deformation unit in accordance with an embodiment. FIG. 5 is a schematic view for explaining operation of the elastic deformation unit according to an embodiment.

Referring to FIGS. 4 and 5, the cylinder 133 according to this embodiment may be formed in an annular shape, and the roller 134 may be disposed eccentrically with respect to the inner circumferential surface 133*b* of the cylinder 133. In other words, one contact point P1 may be formed between the inner circumferential surface 133*b* of the cylinder 133 and the outer circumferential surface 134*a* of the roller 134 as the outer circumferential surface 134*a* of the roller 134 is in contact with the inner circumferential surface 133*b* of the cylinder 133. The suction port 1331 and the discharge port (precisely, the second discharge port) 1313*b* may be formed at both sides of the contact point P1 in the circumferential direction. Accordingly, when the compressor is operated, refrigerant suctioned through the suction port 1331 is compressed while being pushed in a direction toward the contact point P1 by the vane 1351, 1352, 1353 slidably inserted in the roller, and then discharged into the inner space 110*a* of the casing 110 through the discharge port 1313*a*, 1313*b*.

As described above, the pulsation buffer 1332 and the elastic deformation unit 138 may be formed in the cylinder 133. For example, the pulsation buffer 1332 may be located in a suction and compression area (intermediate pressure area) S1, and the elastic deformation unit 138 may be located in a discharge area (discharge pressure area) S2. Accordingly, the pulsation buffer 1332 may communicate with the first main back pressure pocket 1315*a*, 1325*a* forming the intermediate pressure within a short distance, and the elastic deformation unit 138 may suppress or prevent friction loss and/or wear in an area where vane chattering greatly occurs. However, it is unnecessary to form the pulsation buffer 1332 only in the suction and compression area S1, and it is also unnecessary to form the elastic deformation unit 138 only in the discharge area S2. For example, the pulsation buffer 1332 and the elastic deformation unit 138 may also be formed in the suction and compression area S1 and the discharge area S2, respectively.

The pulsation buffer 1332 may be formed in an arcuate shape as described above, and may be located at a center between the outer circumferential surface 133*a* and the inner circumferential surface 133*b* of the cylinder 133. In other words, the pulsation buffer 1332 may be formed such that a distance from an inner wall surface of the pulsation buffer 1332 to the inner circumferential surface 133*b* of the cylinder 133 is equal to or almost equal to a distance from an outer wall surface of the pulsation buffer 1332 to the outer circumferential surface of the cylinder 133. Accordingly, pressure pulsation may be effectively suppressed or prevented by ensuring a rigidity of the cylinder 133 and making a volume of the pulsation buffer 1332 as large as possible.

As described above, the elastic deformation unit 138 may be in an arcuate shape at one side of the pulsation buffer 1332 in the circumferential direction, to be eccentric toward the inner circumferential surface 133*b* of the cylinder 133. In other words, the elastic deformation unit 138 may be formed such that an inner width D22 defined as a distance from the inner wall surface 1381*b* of the space portion 1381, which will be described hereinafter, to the inner circumferential surface 133*b* of the cylinder 133 is shorter than an outer width D21 defined as a distance from the outer wall surface 1381*a* of the space portion 1381 to the outer circumferential surface 133*a* of the cylinder 133. Accordingly, the inner width D22 of the elastic portion 1382 (or inner width of the space portion), which will be described hereinafter, defined as the distance between the inner wall surface 1381*b* of the space portion 1381 and the inner circumferential surface 133*b* of the cylinder 133 may be as thin as possible and the elastic force of the elastic deformation unit 138 may be increased.

In addition, at least one elastic deformation unit 138 may be formed along the circumferential direction of the cylinder 133, but hereinafter, an example in which there is only one elastic deformation unit 138 will first be described.

Referring to FIGS. 4 and 5, the elastic deformation unit 138 may be formed to intersect an imaginary line C1 passing through the contact point P1 from the rotational center Or of the roller 134. In other words, the elastic deformation unit 138 may be formed, encompassing the contact point P1 and a vicinity of the contact point P1. This may suppress or prevent friction loss and/or wear at the contact point P1 and/or in the vicinity of the contact point P1 due to excessive contact between the inner circumferential surface 133*b* of the cylinder 133 and the front end surface 1351*a*, 1352*a*, 1353*a* of the vane or a large impact applied between the same.

In this case, the elastic deformation unit 138 may be formed symmetrically on both sides in the circumferential direction, based on the imaginary line C1. In other words, the elastic deformation unit 138 may be formed such that both sides based on the contact point P1 are symmetric to each other. Accordingly, friction loss and/or wear at the contact point P1 and/or near the contact point P1 may be effectively suppressed or prevented.

However, in some cases, the elastic deformation unit 138 may be formed such that both sides in the circumferential direction based on the imaginary line C1 are asymmetric to each other. In other words, the elastic deformation unit 138 may be formed such that both sides based on the contact point P1 are asymmetric to each other. For example, the elastic deformation unit 138, as illustrated in FIG. 4, may be formed such that a first arcuate length L1 defined as a length to the suction port 1331 from the contact point P1 is longer than a second arcuate length L2 defined as a length to the second discharge port 1313*b* from the contact point P1. In other words, the elastic deformation unit 138 may be formed eccentrically toward the suction port 1331. This may suppress or prevent chattering of the vane in a residual space V4, thereby effectively preventing friction loss and/or wear between the vane 1351, 1352, 1353 which passes through the residual space V4 and the cylinder 133.

In this case, the elastic deformation unit 138 may be formed such that an arcuate length (for example, a second arcuate length) of one side is 10% or more of an entire arcuate length L. In other words, the eccentric length (that is, a first arcuate length) of the elastic deformation unit 138 may be less than 90% of the entire arcuate length L of the elastic deformation unit 138. Accordingly, the elastic deformation unit 138 may secure an appropriate length that can exert elastic force on both sides of the contact point P1, thereby suppressing or preventing friction loss and/or wear at the contact point P1.

Although not illustrated in the drawings, the elastic deformation unit 138 may be formed such that the first arcuate length L1 is longer than the second arcuate length L2 based on the contact point P1. In this case, friction loss and/or wear between the second discharge port and the contact point P1 may be reduced.

Referring to FIGS. 4 and 5, the elastic deformation unit 138 may include the space portion 1381 and the elastic portion 1382. The space portion 1381 may be formed in a coring manner in a portion between the outer circumferential surface 133*a* and the inner circumferential surface 133*b* of the cylinder 133, and the elastic portion 1382 may connect both inner ends of the space portion 1381 to each other to define the inner circumferential surface 133*b* of the cylinder 133. Accordingly, a circumferential length of the space portion 1381 and a circumferential length of the elastic portion 1382 may be equal to each other.

At least a portion of the space portion 1381 may be located radially outside of the second discharge port 1313*b*. For example, the space portion 1381 may be formed near the second discharge port 1313*b* when projected in the axial direction, but may be formed radially outside of the second discharge port 1313*b* so as not to overlap the second discharge port 1313*b*. This may suppress or prevent refrigerant discharged through the second discharge port 1313*b* from partially flowing into the space portion 1381, thereby preventing in advance performance degradation of the compressor due to recompression.

Additionally, the space portion 1381 may be formed between the outer circumferential surface 133*a* and the inner circumferential surface 133*b* of the cylinder 133, and may be eccentric toward the inner circumferential surface 133*b*. In other words, the space portion 1381 may be formed closer to the inner circumferential surface 133*b* of the cylinder 133 than to the outer circumferential surface 133*a*. This may result in increasing the elastic force of the elastic portion 1382.

In addition, a radial width D2 of the space portion 1381 may be shorter than or equal to the inner width D22 of the elastic portion 1382. For example, the radial width D2 of the space portion 1381 may be smaller than the radial width of the elastic portion 1382, which will be described hereinafter, defined as the inner width D22 of the elastic portion 1382. Accordingly, durability of the cylinder 133 may be increased by securing an elastic force of the elastic portion 1382 and minimizing a cross-sectional area of the space portion 1381.

Further, the space portion 1381 may be formed through the cylinder 133 in the axial direction. In other words, the space portion 1381 may be formed as a hole that penetrates in an arcuate shape between both axial side surfaces of the cylinder 133. Accordingly, the space portion 1381 may be easily formed and the entire outer wall surface of the elastic portion 1382 may be spaced apart from the cylinder 133 by the space portion 1381, thereby increasing the elastic force of the elastic portion 1382.

In this case, the space portion 1381 may be formed in the shape of a single arc, as illustrated in FIG. 4, for example, in an arcuate shape having a same curvature as a curvature of the inner circumferential surface of the cylinder 133 at a corresponding portion. Accordingly, the space portion 1381 may be formed through a single machining process, thereby facilitating machining of the space portion 1381.

Referring to FIGS. 4 and 5, the elastic portion 1382 may be formed between the inner circumferential surface 133*b* of the cylinder 133 and the inner wall surface of the space portion 1381, and may typically extend from the inner circumferential surface 133*b* of the cylinder 133. In other words, as the elastic portion 1382 connects both ends of the space portion 1381 inside of the space portion 1381, the inner circumferential surface of the elastic portion 1382 may define a portion of the inner circumferential surface 133*b* of the cylinder 133.

The elastic portion 1382 may be formed to correspond to the space portion 1381. For example, when the space portion 1381 is formed in the shape of a single arc, the elastic portion 1382 may also be formed in the shape of a single arc. In this case, the elastic portion 1382, like the space portion 1381, may intersect the imaginary line C1 passing through the rotational center Or of the roller 134 and the contact point P1. In other words, the elastic portion 1382 may be formed so that at least a portion thereof overlaps the contact point P1 in the radial direction. Accordingly, friction loss and/or wear at the contact point P1 and/or near the contact point P1, on which a relatively large impact acts, may be reduced.

Additionally, the elastic portion 1382 may be formed symmetrically or asymmetrically with respect to the imaginary line C1, similar to the space portion 1381. In these cases, the former may effectively suppress or prevent friction loss and/or wear at the contact point P1 and/or near the contact point P1, and the latter may suppress or prevent vane chattering in the residual space V4, thereby effectively suppressing or preventing friction loss and/or wear between the vane 1351, 1352, 1353 passing through the residual space V4 and the cylinder 133. Descriptions of those cases will be replaced by the description of the space portion 1381.

Additionally, like the space portion 1381, the elastic portion 1382 may be formed so that at least a portion thereof overlaps the second discharge port 1313*b* in the radial direction when projected in the axial direction. For example, at least a portion of the elastic portion 1382 may be formed outside of the second discharge port 1313*b* in the radial direction. This may reduce friction loss and/or wear between the cylinder 133 and the vane 1351, 1352, 1353, which occurs between the second discharge port 1313*b* and the contact point P1, that is, near around the second discharge port 1313*b*.

Additionally, the elastic portion 1382 may further extend in the circumferential direction toward the outside of the second discharge port 1313*b*, that is, toward the suction port 1331, when projected in the axial direction. In this case, the elastic portion 1382 extending between the second discharge port 1313*b* and the suction port 1331 may be disposed outside of the second discharge port 1313*b* in the radial direction. This may reduce friction loss and/or wear between the vane 1351, 1352, 1353 and the cylinder 133 in the residual space V4 which is formed between the second discharge port 1313*b* (or contact point) and the suction port 1331.

When the elastic deformation unit 138 is formed in the cylinder 133 as described above, an impact caused due to chattering of the vane 1351, 1352, 1353 during operation of the compressor may be absorbed. In other words, a kind of chattering phenomenon that the vane 1351, 1352, 1353 is in contact with and is separated from the cylinder 133 due to a pressure difference between both ends of the vane during operation of the compressor occurs.

The elastic portion 1382 of the elastic deformation unit 138 disposed in the cylinder 133, with which the front end surface 1351*a*, 1352*a*, 1353*a* of the vane 1351, 1352, 1353 collides, is bent, as illustrated in FIG. 5, thereby absorbing an impact force caused by the collision between the cylinder 133 and the vane 1351, 1352, 1353. Thus, friction loss and/or wear between the inner circumferential surface 133*b* of the cylinder 133 and the front end surface 1351*a*, 1352*a*, 1353*a* of the vane 1251, 1352, 1353 may be suppressed or prevented. This may minimize an input reduction while maintaining a refrigeration capacity of the compressor, thereby improving compressor efficiency.

Figure 6:
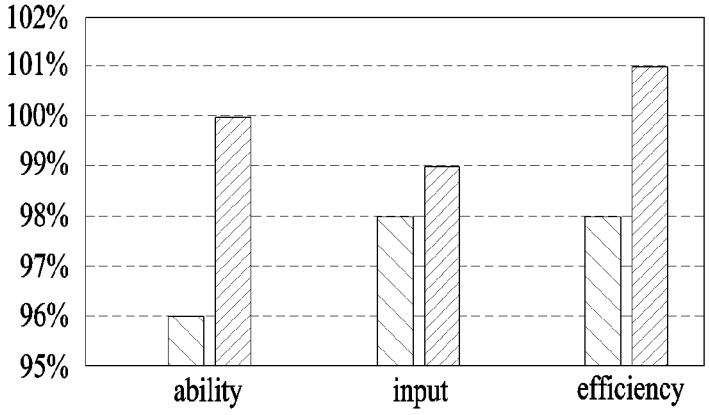
FIG. 6 is a graph for explaining effects of the elastic deformation unit according to an embodiment.

FIG. 6 is a graph for explaining effects of the elastic deformation unit according to an embodiment. As illustrated in FIG. 6, in a case in which the elastic deformation unit 138 is disposed in the cylinder 133 (this embodiment), the refrigeration capacity may be improved by approximately 4%, compared to a case in which the elastic deformation unit is excluded (the related art), thereby securing 100% of refrigeration capacity. In addition, in this embodiment, a motor input may be improved by approximately 1%, compared to the related art, resulting in improving compressor efficiency by about 3%.

In this way, in this embodiment, as the elastic deformation unit is formed in the cylinder, an impact caused due to the collision between the cylinder and the vane may be absorbed, thus, to suppress or prevent friction loss and/or wear between the inner circumferential surface of the cylinder and the front end surface of the vane. This may result in improving compressor efficiency. In particular, an initial actuation failure due to chattering of the vane during initial actuation of the compressor may be prevented, thereby improving the compressor efficiency. In addition, when it is applied to an air conditioning device, air-conditioning effects may be quickly exhibited.

Further, in the rotary compressor according to this embodiment, by forming the elastic deformation unit at the contact point and/or near the contact point, the wear of the inner circumferential surface of the cylinder and/or the front end surface of the vane due to chattering of the vane, which is aggravated around the contact point, may be suppressed or prevented. With this structure, vibration noise in a specific area may be decreased and leakage between compression chambers may be suppressed or prevented, thereby enhancing compression efficiency.

Furthermore, in the rotary compressor according to this embodiment, it may be prevented that the elastic deformation unit acts as a dead volume by disposing the elastic deformation unit not to overlap the discharge port, thereby suppressing or preventing recompression loss. In addition, in the rotary compressor according to this embodiment, the space portion constituting a part or portion of the elastic deformation unit may be formed in the vicinity of the inner circumferential surface of the cylinder, and accordingly, the width of the elastic portion constituting a part or portion of the elastic deformation unit may be as thin as possible, thereby effectively absorbing the impact force of the vane.

Those effects described above may be further expected in the rotary compressor according to the embodiment when a high-pressure refrigerant, such as R32, R410a, or $CO_2$ is used.

Hereinafter, description will be given of an elastic deformation unit according to another embodiment. That is, in the previous embodiment, the elastic deformation unit is the single arcuate hole with one inner diameter, but in some cases, the elastic deformation unit may have a plurality of inner diameters, may be configured by a plurality of holes, or may be formed in a linear shape.

FIGS. 7 to 10 are planar views of an elastic deformation unit of according to various embodiments. Referring back to FIGS. 1 to 3, as the basic configuration and operating effects of the vane rotary compressor according to an embodiment are almost the same as those of the previous embodiment, repetitive description thereof will be replaced with the description of the previous embodiment. For example, roller 134 disposed on rotational shaft 123 may be eccentrically inserted into cylinder 133. The plurality of vane slots 1341*a*, 1341*b*, and 1341*c* may be disposed in the outer circumferential direction of the roller 134 at preset or predetermined intervals along the circumferential direction, and the vanes 1351, 1352, and 1353 may be slidably inserted into the vane slots 1341*a*, 1341*b*, 1341*c*, respectively. Back pressure chambers 1342*a*, 1342*b*, and 1342*c*, which communicate with inner space 110*a* of casing 110 to press the plurality of vanes 1351, 1352, 1353 toward inner circumferential surface 133*b* of the cylinder 133 may be formed in rear end surfaces 1351*b*, 1352*b*, 1353*b* of the vanes 1351, 1352, and 1353, respectively. Accordingly, each vane 1351, 1352, 1353 may be pushed by the centrifugal force generated when the roller 134 rotates and the back pressure of the back pressure chamber 1342*a*, 1342*b*, 1342*c*, to be brought into close contact with the inner circumferential surface 133*b* of the cylinder 133, thereby compressing refrigerant.

In this case, vane chattering that the vane 1351, 1352, 1353 shakes due to a pressure difference between its ends and thereby is separated from and in contact with the inner circumferential surface 133*b* of the cylinder may occur, which may cause friction loss and/or wear between the cylinder 133 and the vane 1351, 1352, 1353. Accordingly, the cylinder 133 may include elastic deformation unit 138 that may absorb an impact between the vane 1351, 1352, 1353 and the cylinder 133 due to the vane chattering, to thus reduce friction loss and/or wear. As the basic configuration of the elastic deformation unit 138 and its operating effects are similar to those in the previous embodiment, repetitive description will be replaced by the description of the previous embodiment.

Figure 7:
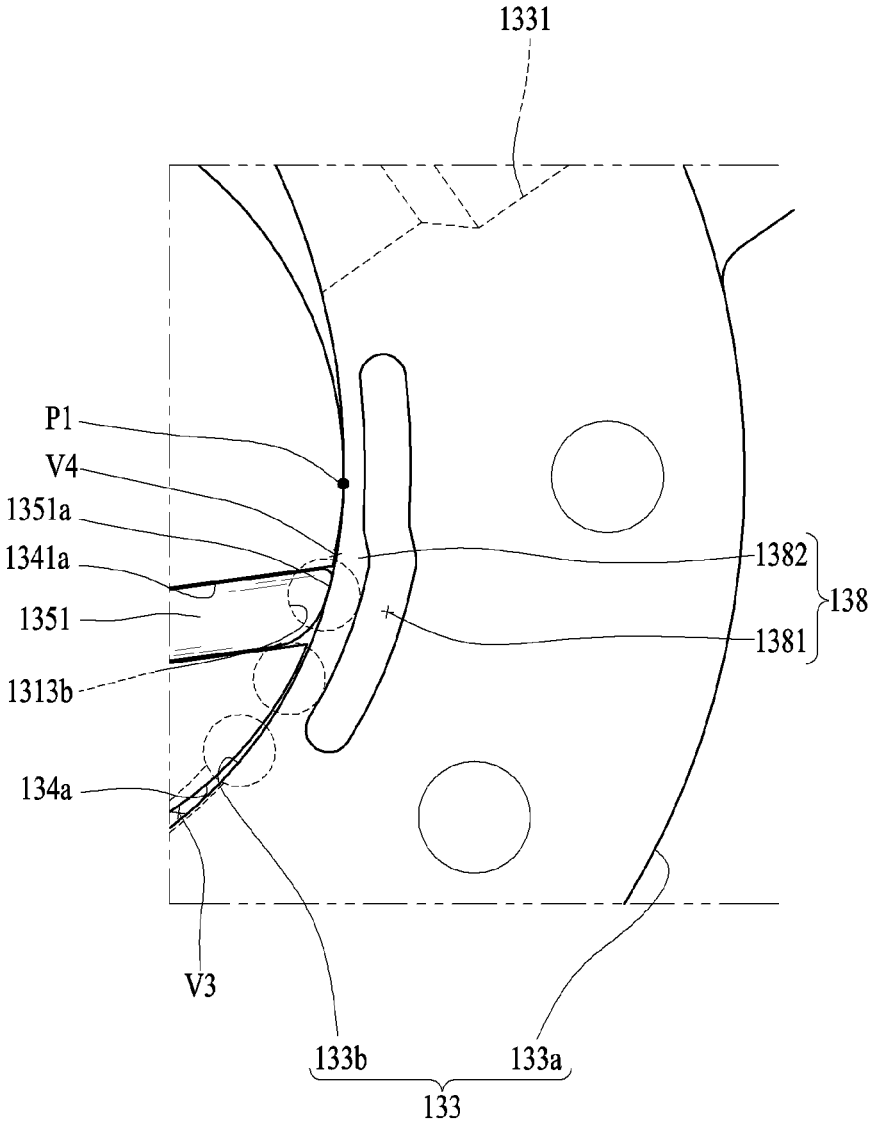
FIGS. 7 to 10 are planar views of an elastic deformation unit according to various embodiments.

However, as illustrated in FIG. 7, when the space portion 1381 and the elastic portion 1382 extend in the circumferential direction to be closer to the suction port 1331 than to the second discharge port 1313*b*, parts or portions of the space portion 1381 and the elastic portion 1382, which are closer to the suction port 1331 than to the second discharge port 1313*b*, may also be disposed to overlap the second discharge port 1313*b* in the circumferential direction. In this case, the space portion 1381 and the elastic portion 1382 may be located to be much closer to the inner circumferential surface 133*b* of the cylinder 133 at a point beyond the second discharge port 1313*b*, for example, at the contact point P1 and between the contact point P1 and the suction port 1331, to thus further increase the elastic force of the elastic portion 1382 explained hereinafter. This may more effectively reduce friction loss and/or wear at the contact point P1 and between the contact point P1 and the suction port 1331, that is, in the residual space V4.

Figure 8:
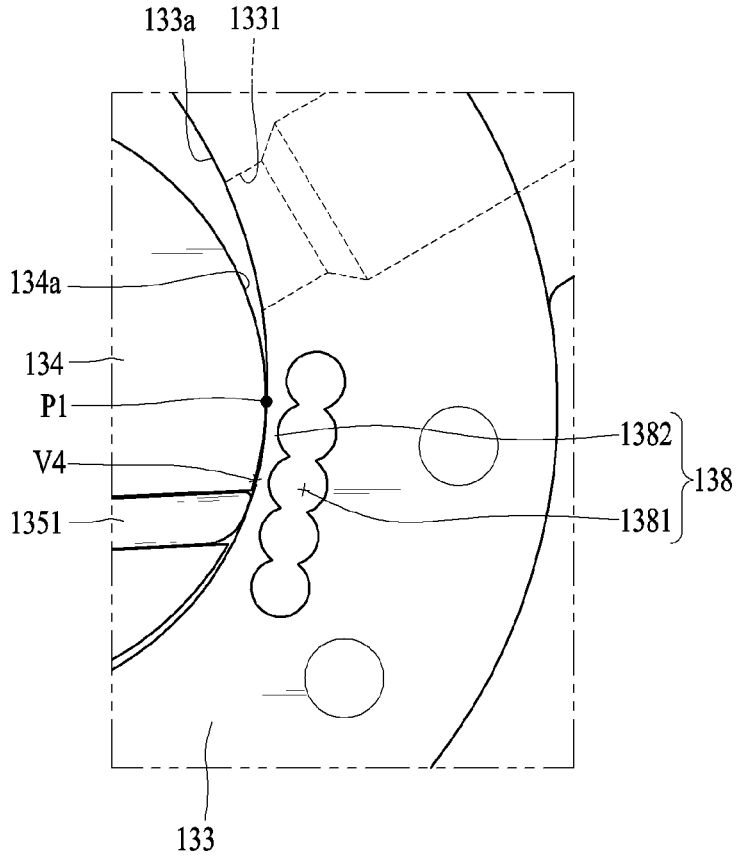

Additionally, as illustrated in FIG. 8, the space portion 1381 may be formed in an arcuate shape by connecting a plurality of circular holes. In this case, the space portion 1381 may be formed through simple milling, which may further facilitate machining of the space portion 1381.

Figure 9:
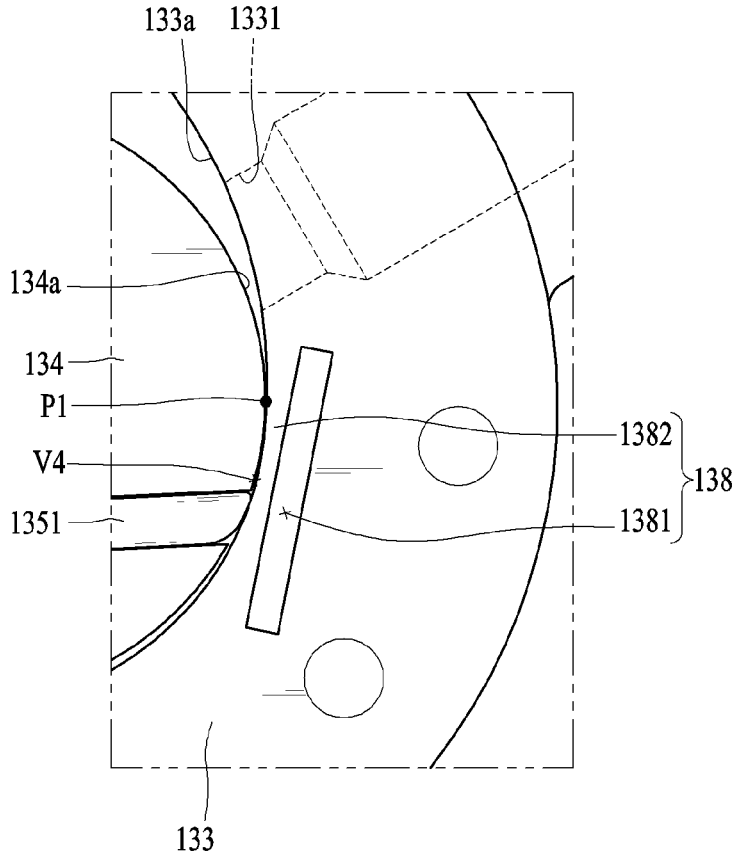

Additionally, as illustrated in FIG. 9, the space portion 1381 may be formed in a linear shape. In this case, the elastic portion 1382 may be formed to be thin in width only at a portion where deformation of the cylinder 133 is greatest, for example, at the portion of the contact point P1, while both ends of the elastic portion 1382 may be formed thick to increase actual elastic force and enhance reliability.

Figure 10:
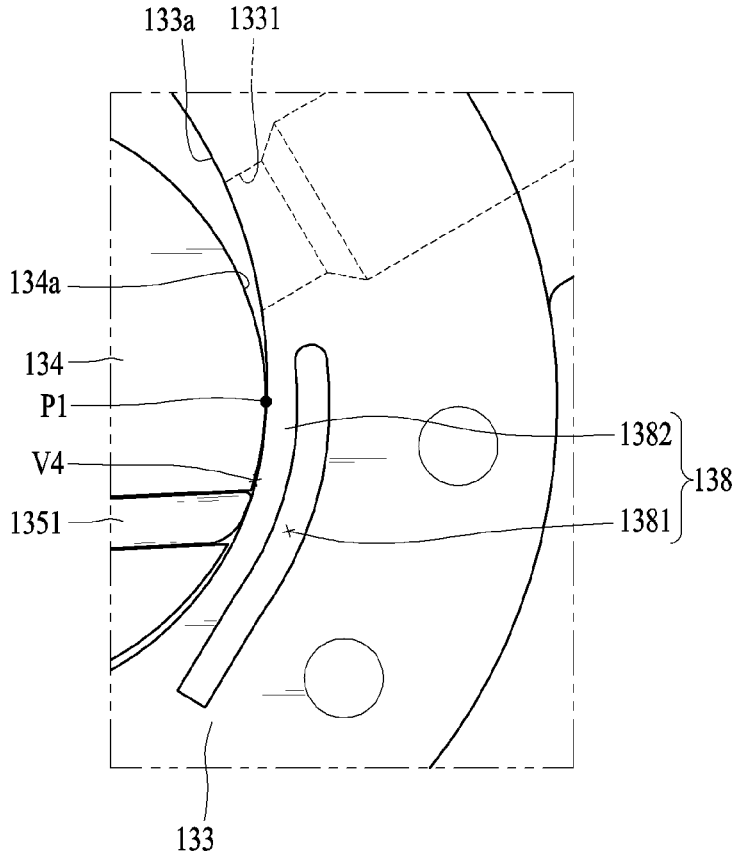

Further, as illustrated in FIG. 10, the space portion 1381 may be formed in a combined shape of a linear shape and an arcuate shape. In this case, the space portion 1381 may be formed in the linear shape between the second discharge port 1313*b* and the contact point P1 and in a curved shape between the contact point P1 and the suction port 1331. Accordingly, a portion far from the contact point P1 may be formed in the linear shape to increase durability of the cylinder 133, while a portion close to the contact point P1 may be formed in the curved shape like the inner circumferential surface 133*b* of the cylinder 133 to increase impact absorption.

Hereinafter, description will be given of an elastic deformation unit according to still another embodiment. That is, in the previous embodiment, the single elastic deformation unit is disposed, but in some cases, the elastic deformation unit may be provided as a plurality.

Figure 11:
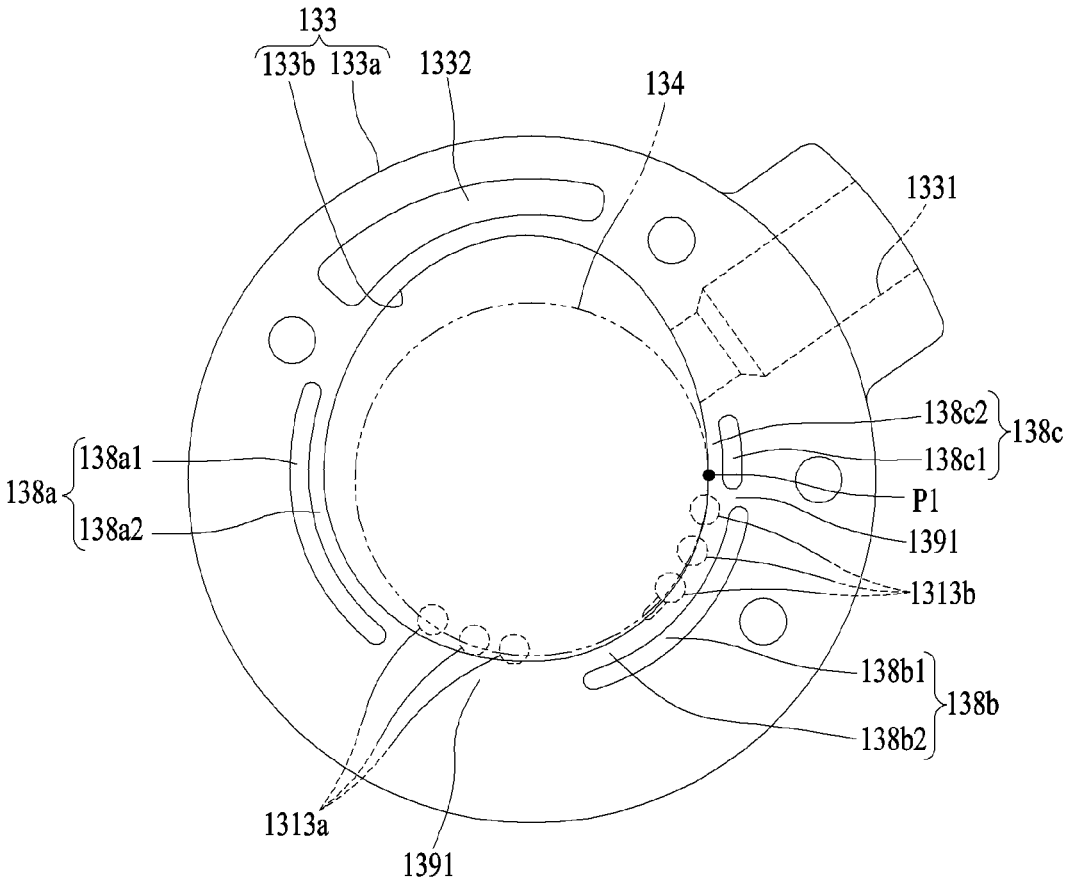
FIG. 11 is a planar view of an elastic deformation unit according to another embodiment.

FIG. 11 is a planar view of an elastic deformation unit according to another embodiment. Referring to FIG. 11, as the basic configuration and operating effects of the vane rotary compressor according to this embodiment are almost the same as those of the previous embodiment, repetitive description thereof will be replaced with the description of the previous embodiment. For example, roller 134 disposed on rotational shaft 123 may be eccentrically inserted into cylinder 133. The plurality of vane slots 1341*a*, 1341*b*, and 1341*c* may be disposed in the outer circumferential direction of the roller 134 at preset or predetermined intervals along the circumferential direction, and the vanes 1351, 1352, and 1353 may be slidably inserted into the vane slots 1341*a*, 1341*b*, 1341*c*, respectively. Back pressure chambers 1342*a*, 1342*b*, and 1342*c*, which communicate with inner space 110*a* of casing 110 to press the plurality of vanes 1351, 1352, 1353 toward inner circumferential surface 133*b* of the cylinder 133 may be formed in rear end surfaces 1351*b*, 1352*b*, 1353*b* of the vanes 1351, 1352, and 1353, respectively. Accordingly, each vane 1351, 1352, 1353 may be pushed by the centrifugal force generated when the roller 134 rotates and the back pressure of the back pressure chamber 1342*a*, 1342*b*, 1342*c*, to be brought into close contact with the inner circumferential surface 133*b* of the cylinder 133, thereby compressing refrigerant.

In this case, vane chattering that the vane 1351, 1352, 1353 shakes due to a pressure difference between its ends and thereby is separated from and in contact with the inner circumferential surface 133*b* of the cylinder may occur, which may cause friction loss and/or wear between the cylinder 133 and the vane 1351, 1352, 1353. Accordingly, the cylinder 133 may include elastic deformation unit 138 that may absorb an impact between the vane 1351, 1352, 1353 and the cylinder 133 due to the vane chattering, to thus reduce friction loss and/or wear. As the basic configuration of the elastic deformation unit 138 and its operating effects are similar to those in the previous embodiment, repetitive description will be replaced by the description of the previous embodiment.

However, in this embodiment, the elastic deformation unit 138 may be provided as a plurality, which are spaced apart from one another along the circumferential direction. For example, the elastic deformation units 138 may include first elastic deformation unit 138*a*, second elastic deformation unit 138*b*, and third elastic deformation unit 138*c*. The first elastic deformation unit 138*a* may include first space portion 138*a*1 and first elastic portion 138*a*2, the second elastic deformation unit 138*b* may include second space portion 138*b*1 and second elastic portion 138*b*2, and the third elastic deformation unit 138*c* may include third space portion 138*c*1 and third elastic portion 138*c*2. The first space portion 138*a*1 and the first elastic portion 138*a*2 constituting the first elastic deformation unit 138*a*, the second space portion 138*b*1 and the second elastic portion 138*b*2 constituting the second elastic deformation unit 138*b*, and the third space portion 138*c*1 and the third elastic portion 138*c*2 constituting the third elastic deformation unit 138*c* have configurations and provide operating effects similar to those of the previous embodiment, so repetitive description will be replaced by the description of the previous embodiment.

The first elastic deformation unit 138*a* may extend in the circumferential direction between pulsation buffer 1332 and first discharge port 1313*a*, the second elastic deformation unit 138*b* may extend between first discharge port 1313*a* and second discharge port 1313*a*, and the third elastic deformation portion 138*c* may extend between second discharge port 1313*b* and suction port 1331 in the circumferential direction. Accordingly, the first elastic deformation unit 138*a* may be the longest, and the third elastic deformation part 138*c* may be the shortest.

However, the first elastic deformation unit 138*a* may be formed not to overlap the first discharge port 1313*a* in the radial direction. In this case, the first elastic deformation unit 138*a* may be formed to overlap the first discharge port 1313*a* in the circumferential direction. Accordingly, the first elastic portion 138*a*2 constituting the first elastic deformation unit 138*a* may be thin, thereby reducing friction loss and/or wear between the pulsation buffer 1332 and the first discharge port 1313*a*.

The second elastic deformation unit 138*b* may be formed to overlap the second discharge port 1313*b* in the radial direction. In this case, the second elastic deformation unit 138*b* may be formed not to overlap the second discharge port 1313*b* in the circumferential direction, in other words, to be located outside of the second discharge port 1313*b*. This may suppress or prevent the first space portion 138*a*1 constituting the second elastic deformation unit 138*b* from communicating with the second discharge port 1313*b*, thereby suppressing or preventing performance degradation of the compressor due to recompression.

The third elastic deformation unit 138*c* may be formed to overlap the contact point P1 in the radial direction. In this case, the third elastic deformation unit 138*c* may be formed not to overlap the second discharge port 1313*b* in the radial direction. Accordingly, the third elastic portion 138*c*2 constituting the third elastic deformation unit 138*c* may be thin, thereby reducing friction loss and/or wear at the contact point P1 and/or near the contact point P1.

As described above, as the first to third elastic deformation units 138*a* to 138*c* are spaced apart by preset or predetermined distances along the circumferential direction, first connection portions 1391 that connect the outer circumferential surface 133*a* and the inner circumferential surface 133*b* of the cylinder 133 may be formed between the elastic deformation units 138*a*, 138*b*, 138*c* adjacent to each other in the circumferential direction. This may minimize deformation of the cylinder 133 due to the elastic deformation unit 138 while extending the circumferential length of the elastic deformation unit 138 as long as possible.

Hereinafter, description will be given of an elastic deformation unit according to still another embodiment. That is, in the previous embodiments, the elastic deformation unit is formed as a hole that penetrates both axial side surfaces of the cylinder, but in some cases, the elastic deformation unit may be formed as a groove that is recessed by a preset or predetermined depth into an axial side surface of the cylinder.

Figure 12:
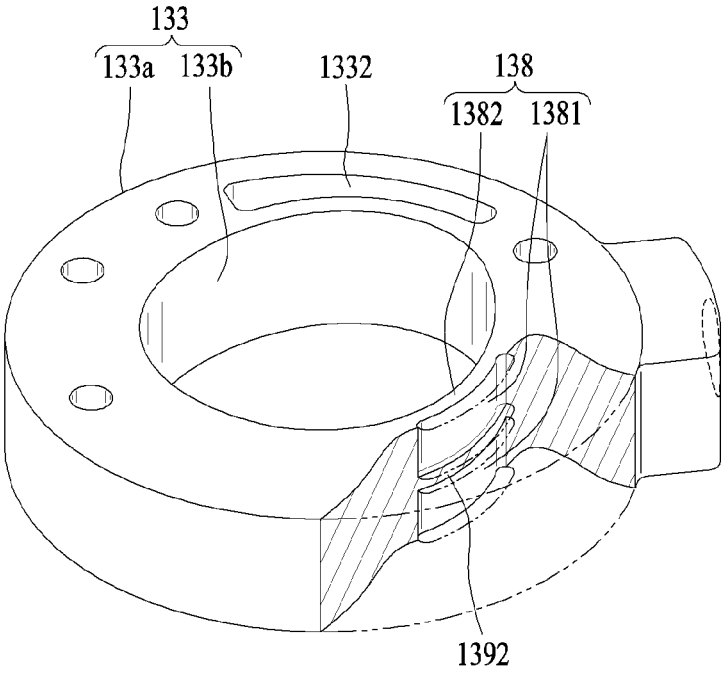
FIG. 12 is a cut perspective view of an elastic deformation unit according to still another embodiment.

FIG. 12 is a cut perspective view of an elastic deformation unit according to still another embodiment. Referring to FIG. 12, as the basic configuration and operating effects of the vane rotary compressor according to this embodiment are almost the same as those of the previous embodiment, repetitive description thereof will be replaced with the description of the previous embodiment. For example, roller 134 disposed on rotational shaft 123 may be eccentrically inserted into cylinder 133. The plurality of vane slots 1341*a*, 1341*b*, and 1341*c* may be disposed in the outer circumferential direction of the roller 134 at preset or predetermined intervals along the circumferential direction, and vanes 1351, 1352, and 1353 may be slidably inserted into the vane slots 1341*a*, 1341*b*, 1341*c*, respectively. Back pressure chambers 1342*a*, 1342*b*, and 1342*c*, which communicate with the inner space 110*a* of the casing 110 to press the plurality of vanes 1351, 1352, 1353 toward the inner circumferential surface 133*b* of the cylinder, may be formed in rear end surfaces 1351*b*, 1352*b*, 1353*b* of the vanes 1351, 1352, and 1353, respectively. Accordingly, each vane 1351, 1352, 1353 may be pushed by the centrifugal force generated when the roller 134 rotates and the back pressure of the back pressure chamber 1342*a*, 1342*b*, 1342*c*, to be brought into close contact with the inner circumferential surface 133*b* of the cylinder 133, thereby compressing refrigerant.

In this case, vane chattering that the vane 1351, 1352, 1353 shakes due to a pressure difference between its both ends and thereby is separated from and in contact with inner circumferential surface 133*b* of the cylinder 133 may occur, which may cause friction loss and/or wear between the cylinder 133 and the vane 1351, 1352, 1353. Accordingly, the cylinder 133 may include elastic deformation unit 138 that may absorb an impact between the vane 1351, 1352, 1353 and the cylinder 133 due to the vane chattering, to thus reduce friction loss and/or wear. As the basic configuration of the elastic deformation unit 138 and its operating effects are similar to those in the previous embodiments, repetitive description will be replaced by the description of the previous embodiments.

However, in this embodiment, the elastic deformation unit 138 may be recessed by preset or predetermined depths into both axial side surfaces of the cylinder 133. In other words, the elastic deformation unit 138 may be formed as a groove having a predetermined depth in the axial direction.

For example, the elastic deformation unit 138 may include space portion 1381 and elastic portion 1382, and second connection portion 1392 may be formed inside of the space portion 1381 and connected across the space portion 1381. The second connection portion 1392 may connect the outer wall surface and the inner wall surface of the space portion 1381, and the elastic portion 1382 may be connected to the outer wall surface 1381*a* of the space portion 1381 by the second connection portion 1381. Accordingly, the elastic portion 1382 may be supported in the radial direction by the second connection portion 1392 and may be suppressed or prevented from being excessively deformed, thereby increasing durability of the cylinder 133.

Further, the second connection portion 1392 may be formed as thin as possible at a mid-height of the space portion 1381. Accordingly, the second connection portion 1392 may be located in the middle of the vane 1351, 1352, 1353 in the axial direction, which may result in suppressing or preventing unstable behavior of the vane 1351, 1352, 1353 due to the second connection portion 1392.

Embodiments disclosed herein provide a rotary compressor that is capable of increasing compression efficiency by reducing friction loss and/or wear due to an excessive contact between a vane and a cylinder during operation.

Embodiments disclosed herein also provide a rotary compressor that is capable of reducing friction loss and/or wear due to an excessive contact between a vane and a cylinder by aggregating collision force that is applied by the vane to the cylinder during operation.

Embodiments disclosed herein further provide a rotary compressor that is capable of increasing compression efficiency by suppressing or preventing wear of a vane and/or cylinder due to collision between the vane and the cylinder during operation.

Embodiments disclosed herein furthermore provide a rotary compressor that is capable of suppressing or preventing wear due to collision between a vane and a cylinder by absorbing a force causing the vane to collide with the cylinder during operation.

Embodiments disclosed herein provide a rotary compressor that is capable of suppressing or preventing wear of a vane and/or cylinder due to chattering of the vane that occurs near a contact point where a roller is located close to the cylinder.

Embodiments disclosed herein additionally provide a rotary compressor capable of suppressing or preventing chattering of a vane even when a high-pressure refrigerant, such as R32, R410a, or $CO_2$ is used.

Embodiments disclosed herein provide a rotary compressor that may include a casing, a cylinder, a main bearing, a sub bearing, a rotational shaft, a roller, and at least one vane. The cylinder may be fixed inside of the casing to define a compression space. The main bearing and the sub bearing may be respectively disposed on both sides of the cylinder in an axial direction. The rotational shaft may be supported by the main bearing and the sub bearing. The roller may be disposed on a rotational shaft to be rotatable, and form at least one contact point at which an outer circumferential surface thereof is in contact with an inner circumferential surface of the cylinder. The at least one vane may be slidably inserted into the roller, and have a front end surface brought into contact with the inner circumferential surface of the cylinder to divide the compression space into a plurality of compression chambers. The cylinder may include at least one elastic deformation unit configured to absorb an impact with the vane. With this structure, a collision force caused by chattering of the vane may be absorbed to suppress or prevent friction loss and/or wear between the cylinder and the vane, enhancing compressor efficiency, reducing vibration noise, and enabling fast initial actuation.

The at least one elastic deformation unit may be formed to intersect an imaginary line passing through a rotational center of the roller and the contact point. This may effectively absorb a collision force of the vane at a portion at which the vane chatters severely, further suppressing or preventing friction loss and/or wear between the cylinder and the vane.

The elastic deformation unit may be provided as one in number, and the elastic deformation unit may be formed such that both sides thereof in a circumferential direction are symmetrical to each other on the basis of the imaginary line. With this structure, a collision force generated on both circumferential sides of the contact point due to the vane chattering may be absorbed, thereby more effectively suppressing or preventing friction loss and/or wear between the cylinder and vane.

Additionally, the elastic deformation unit may be provided as one in number, and may be formed such that both sides thereof in a circumferential direction are asymmetrical to each other on the basis of the imaginary line. With this structure, a collision force generated on a portion, at which the vane chattering is relatively more severe, based on the contact point may be effectively absorbed, thereby more evenly suppressing or preventing the friction loss and/or wear between the cylinder and vane.

More specifically, the elastic deformation unit may be formed such that a circumferential length of one side thereof is 10% or more of a total circumferential length. With this structure, friction loss and/or wear between the cylinder and the vane may be suppressed or prevented more evenly by preventing a collision force due to the vane chattering on any one side of the contact point from being excessively ignored.

Also, the at least one elastic deformation unit may be provided as a plurality that are spaced apart by preset or predetermined intervals along the circumferential direction. One elastic deformation unit among the plurality of elastic deformation units may be formed to intersect the imaginary line passing through the rotational center of the roller and the contact point. With this structure, even when there are a plurality of elastic deformation units, a vane collision force at a portion where vane chattering occurs severely may be effectively absorbed, thereby more effectively suppressing or preventing friction loss and/or wear between the cylinder and the vane.

The elastic deformation unit may include a space portion and an elastic portion. The space portion may be formed in a coring manner between an outer circumferential surface of the cylinder and the inner circumferential surface of the cylinder. The elastic portion may connect both inner ends of the space portion and define the inner circumferential surface of the cylinder. This may effectively absorb a collision force due to the vane at a portion where the vane chatters severely, further suppressing or preventing friction loss and/or wear between the cylinder and the vane.

The space portion may be eccentric toward the inner circumferential surface of the cylinder. With this structure, the elastic portion constituting a portion of the elastic deformation unit may be disposed close to the inner circumferential surface of the cylinder, thereby increasing durability of the cylinder and more effectively absorbing and canceling out the collision force due to the vane chattering.

A discharge port may be formed in at least one of the main bearing or the sub bearing, and at least a portion of the space portion may overlap the discharge port in the radial direction. The space portion that overlaps the discharge port in the radial direction may be formed at an outside of the discharge port in the radial direction. This may prevent the space portion constituting the portion of the elastic deformation unit from overlapping the discharge port, thereby suppressing or preventing generation of a dead volume due to the space portion.

More specifically, a space portion that does not overlap the discharge port in the radial direction, among the space portions of the plurality of elastic deformation units, may be formed such that at least a portion thereof overlaps the discharge port in the circumferential direction. With this structure, an elastic deformation unit, which departs from a circumferential range of the discharge port, among the elastic deformation units may be formed to be as close as possible to the inner circumferential surface of the cylinder, thereby more effectively absorbing and canceling out collision force due to vane chattering while increasing durability of the cylinder.

A discharge port may be formed in at least one of the main bearing or the sub bearing, and the space portion may be formed outside the discharge port not to overlap the discharge port. The elastic portion may be formed such that at least a portion thereof overlaps the discharge port in the axial direction. With this structure, the elastic portion constituting the elastic deformation unit may be disposed close to the inner circumferential surface of the cylinder while the space portion constituting a portion of the elastic deformation unit does not communicate with the discharge port, thereby more effectively absorbing and canceling out a collision force due to vane chattering.

A radial width of the space portion may be smaller than or equal to a radial width of the elastic portion. This may increase a collision absorption ability of the elastic portion while minimizing a volume of the space portion, securing durability of the cylinder.

The space portion may be formed in a curved shape, a linear shape, or a combined shape of the linear shape and the curved shape. This may reduce a width of the elastic portion at a specific area such as the contact point, to effectively absorb a vane collision force or facilitate machining. Also, the space portion may be formed in a same shape as the inner circumferential surface of the cylinder while absorbing the vane collision force effectively, thereby securing durability of the cylinder.

More specifically, the space portion may be formed in a combined shape of the linear shape and the curved shape. A portion of the spaced portion that intersects the imaginary line passing through the rotational center of the roller and the contact point may be formed in the curved shape. With this structure, the space portion can may be formed in the same shape as the inner circumferential surface of the cylinder while effectively absorbing a vane collision force at the contact point and/or near the contact point, thereby securing durability of the cylinder.

A back pressure pocket may be formed at the main bearing and/or the sub bearing to supply back pressure to a rear end surface of the vane, and a pulsation buffer that communicates with the back pressure pocket may be formed at one side of the space portion in the circumferential direction. A radial width of the space portion may be equal to or smaller than a radial width of the pulsation buffer. This may reduce a volume of the space portion as small as possible while securing the elastic force of the elastic deformation unit, thereby increasing durability of the cylinder.

The space portion may be formed through the cylinder in the axial direction. This may secure the elastic force of the elastic portion as high as possible while facilitating machining. The space portion may be recessed by a preset or predetermined depth into at least one of both axial side surfaces of the cylinder. This may increase reliability of the elastic portion while securing elasticity of the elastic portion.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a casing;

a cylinder fixed inside of the casing to define a compression space;

a main bearing and a sub bearing respectively disposed on both sides of the cylinder in an axial direction;

a rotational shaft supported on the main bearing and the sub bearing;

a roller disposed on the rotational shaft to be rotatable, and forming at least one contact point at which an outer circumferential surface thereof is in contact with an inner circumferential surface of the cylinder; and at least one vane slidably inserted into the roller, and having a front end surface brought into contact with the inner circumferential surface of the cylinder to divide the compression space into a plurality of compression chambers, wherein the cylinder comprises at least one elastic deformation unit configured to absorb an impact with the at least one vane, wherein each of the at least one elastic deformation unit comprises:

a space portion formed between an outer circumferential surface of the cylinder and the inner circumferential surface of the cylinder; and an elastic portion that connects inner ends of the space portion and defines the inner circumferential surface of the cylinder, and at least a portion of an outer circumferential surface of the elastic portion is formed in an arcuate shape in a circumferential direction.

2. The rotary compressor of claim 1, wherein the at least one elastic deformation unit is formed to intersect an imaginary line that passes through a rotational center of the roller and the contact point.

3. The rotary compressor of claim 2, wherein sides of the at least one elastic deformation unit in the circumferential direction are symmetrical to each other on the basis of the imaginary line.

4. The rotary compressor of claim 2, wherein sides of the at least one elastic deformation unit in the circumferential direction are asymmetrical to each other on the basis of the imaginary line.

5. The rotary compressor of claim 4, wherein a circumferential length of one side of the at least one elastic deformation unit with respect to the imaginary line is 10% or more of a total circumferential length of the at least one elastic deformation unit.

6. The rotary compressor of claim 2, wherein the at least one elastic deformation unit comprises a plurality of elastic deformation units that is spaced apart by predetermined intervals along the circumferential direction, and wherein one elastic deformation unit among the plurality of elastic deformation units is formed to intersect the imaginary line passing through the rotational center of the roller and the contact point.

7. The rotary compressor of claim 1, wherein the space portion is eccentric toward the inner circumferential surface of the cylinder.

8. The rotary compressor of claim 1, wherein at least one discharge port is formed in at least one of the main bearing or the sub bearing, wherein at least a portion of the space portion overlaps the at least one discharge port in a radial direction, and wherein the space portion that overlaps the at least one discharge port in the radial direction is formed at an outside of the at least one discharge port in the radial direction.

9. The rotary compressor of claim 8, wherein the at least one elastic deformation unit comprises a plurality of elastic deformation units that is spaced apart by predetermined intervals along the circumferential direction, and wherein a space portion that does not overlap the at least one discharge port in the radial direction, among space portions of the plurality of elastic deformation units, is formed such that at least a portion thereof overlaps the at least one discharge port in the circumferential direction.

10. The rotary compressor of claim 1, wherein at least one discharge port is formed in at least one of the main bearing or the sub bearing, wherein the space portion is formed outside of the at least one discharge port so as not to overlap the at least one discharge port, and wherein at least a portion of the elastic portion overlaps the at least one discharge port in the axial direction.

11. The rotary compressor of claim 1, wherein a radial width of the space portion is smaller than or equal to a radial width of the elastic portion.

12. The rotary compressor of claim 1, wherein the space portion is formed in a curved shape, a linear shape, or a combined shape of the linear shape and the curved shape.

13. The rotary compressor of claim 12, wherein the space portion is formed in the combined shape of the linear shape and the curved shape, and a portion of the space portion that intersects the imaginary line passing through the rotational center of the roller and the contact point is formed in the curved shape.

14. The rotary compressor of claim 1, wherein at least one back pressure pocket is formed in at least one of the main bearing or the sub bearing to supply back pressure to a rear end surface of the at least one vane, wherein a pulsation buffer that communicates with the at least one back pressure pocket is formed at one side of the space portion in the circumferential direction, and wherein a radial width of the space portion is equal to or smaller than a radial width of the pulsation buffer.

15. The rotary compressor of claim 1, wherein the space portion is formed through the cylinder in the axial direction.

16. The rotary compressor of claim 1, wherein the space portion is recessed by a predetermined depth into at least one of axial side surfaces of the cylinder.

17. A rotary compressor, comprising:

a casing;

a cylinder fixed inside of the casing to define a compression space;

a main bearing and a sub bearing respectively disposed on both sides of the cylinder in an axial direction;

a rotational shaft supported on the main bearing and the sub bearing;

a roller disposed on the rotational shaft to be rotatable, and forming at least one contact point at which an outer circumferential surface thereof is in contact with an inner circumferential surface of the cylinder; and at least one vane slidably inserted into the roller, and having a front end surface brought into contact with the inner circumferential surface of the cylinder to divide the compression space into a plurality of compression chambers, wherein the cylinder comprises at least one elastic deformation unit configured to absorb an impact with the at least one vane, and wherein each of the at least one elastic deformation unit comprises:

a space portion in the form of an opening or at least one groove between an outer circumferential surface of the cylinder and the inner circumferential surface of the cylinder; and an elastic portion disposed adjacent to the opening or the at least one groove, extending in a circumferential direction, and forming the inner circumferential surface of the cylinder, wherein at least a portion of an outer circumferential surface of the elastic portion is formed in an arcuate shape in the circumferential direction.

18. The rotary compressor of claim 17, wherein a radial width of the space portion is smaller than or equal to a radial width of the elastic portion.

19. The rotary compressor of claim 17, wherein the space portion is formed in a curved shape, a linear shape, or a combined shape of the linear shape and the curved shape.

* * * * *